US006731771B2

(12) United States Patent
Cottrell

(10) Patent No.: US 6,731,771 B2
(45) Date of Patent: May 4, 2004

(54) FOAM MOUNTED RECEIVER FOR COMMUNICATION HEADSET

(75) Inventor: Melvin M. Cottrell, Glendora, CA (US)

(73) Assignee: AVCOMM International, Inc., Covina, CA (US)

( * ) Notice: Subject to any disclaimer, the term of this patent is extended or adjusted under 35 U.S.C. 154(b) by 117 days.

(21) Appl. No.: 09/751,703

(22) Filed: Dec. 29, 2000

(65) Prior Publication Data

US 2002/0085733 A1 Jul. 4, 2002

(51) Int. Cl.[7] ..... H04R 25/00
(52) U.S. Cl. ..... 381/371; 381/370; 381/372
(58) Field of Search ..... 381/370, 371, 381/374, 376, 372, 373, 375, 384, 361, 362, 71.6; 181/181, 129

(56) References Cited

U.S. PATENT DOCUMENTS 4,087,653 A * 5/1978 Frieder et al. ..... 381/370
4,523,661 A * 6/1985 Scalzo et al. ..... 181/129
5,020,163 A * 6/1991 Aileo et al. ..... 381/371
5,148,887 A * 9/1992 Murphy ..... 181/129
5,185,807 A * 2/1993 Bergin et al. ..... 381/370
5,519,783 A * 5/1996 Kumar ..... 381/371
5,675,658 A * 10/1997 Brittain ..... 381/370
5,991,422 A * 11/1999 Chiang ..... 381/370
6,081,604 A * 6/2000 Hikichi et al. ..... 381/371

* cited by examiner

*Primary Examiner*—Rexford Barnie
(74) *Attorney, Agent, or Firm*—Larry K. Roberts; Peter Reitan

(57) ABSTRACT

A communication headset includes at least one dome structure for fitting over a user's ear, the dome structure comprising a rigid outer housing defining an earpiece cavity. A support structure supports the at least one dome structure in place covering the user's ear. An audio transducer is positioned within the cavity for converting electrical signals into audible signals. A suspension structure supports the transducer within the cavity without any rigid connection between the transducer and the rigid outer housing. Flexible wiring is passed between the transducer and an external connector structure, the wiring for carrying the electrical signals to the transducer.

48 Claims, 2 Drawing Sheets

FIG. 1
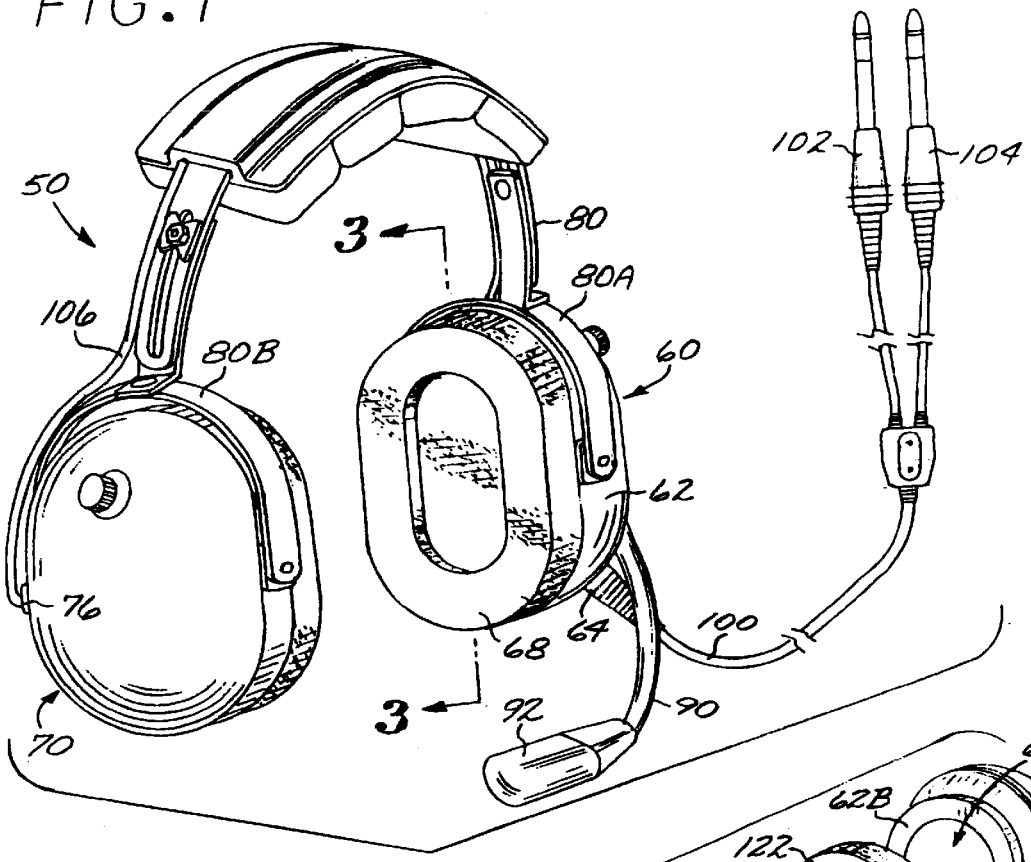
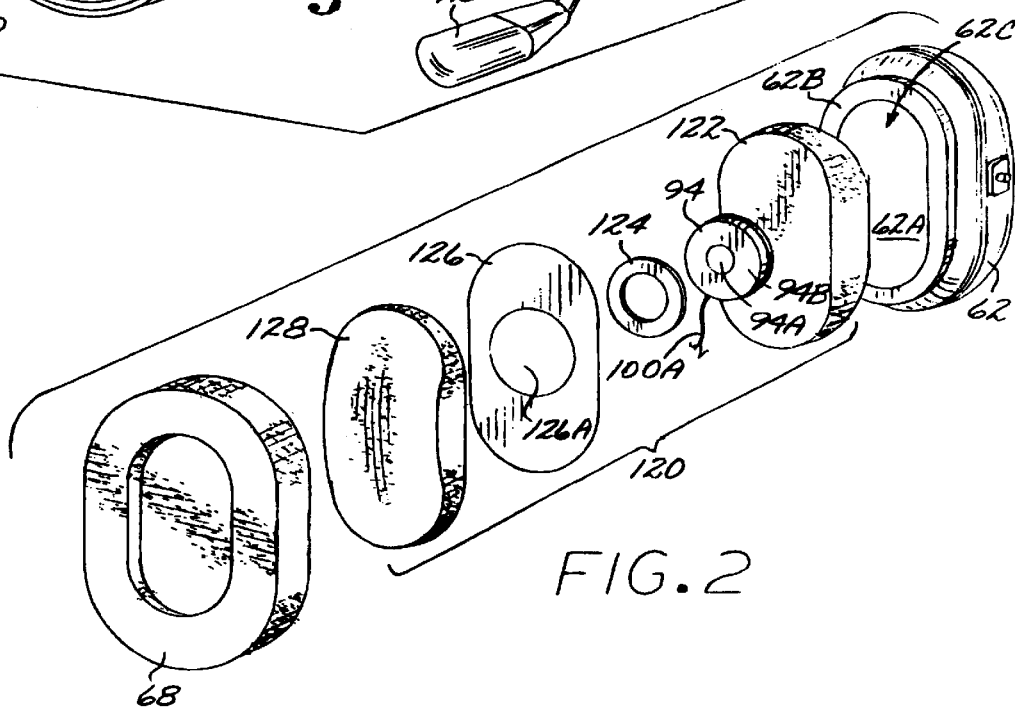
FIG. 2

FOAM MOUNTED RECEIVER FOR COMMUNICATION HEADSET

TECHNICAL FIELD OF THE INVENTION

This invention relates to headsets, for example communication headsets.

BACKGROUND OF THE INVENTION

Communication headsets are used in many applications, including applications with high ambient noise levels. One exemplary application is the aviation industry. Communication headsets are used in commercial, military and general aviation, by pilots and other members of the flight crew. High ambient noise levels from engine noise and other noise sources can make it difficult to hear the audio signals from the audio transducers or receivers mounted in the headsets.

Another exemplary application for headsets is the auto racing field, wherein radios are used for communication between members of the race crew, e.g. between the pit crew and the driver. The high ambient noise levels at these racing events make it difficult for voice communications to be heard.

Active noise cancelling headsets represent one approach to reducing the effects of high ambient noise, but these are expensive.

SUMMARY OF THE INVENTION

A communication headset is described, which includes at least one dome structure for fitting over a user's ear, the dome structure comprising a rigid outer housing defining an earpiece cavity. A support structure supports the at least one dome structure in place covering the user's ear. An audio transducer is positioned within the cavity for converting electrical signals into audible signals. A suspension structure supports the transducer within the cavity without any rigid connection between the transducer and the rigid outer housing. Flexible wiring is passed between the transducer and an external connector structure, the wiring for carrying the electrical signals to the transducer.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is an isometric view of a communication headset embodying this invention.

FIG. 2 is an exploded isometric view of elements of one dome structure comprising the headset of FIG. 1.

DETAILED DESCRIPTION OF THE PREFERRED EMBODIMENTS

Figure 3:
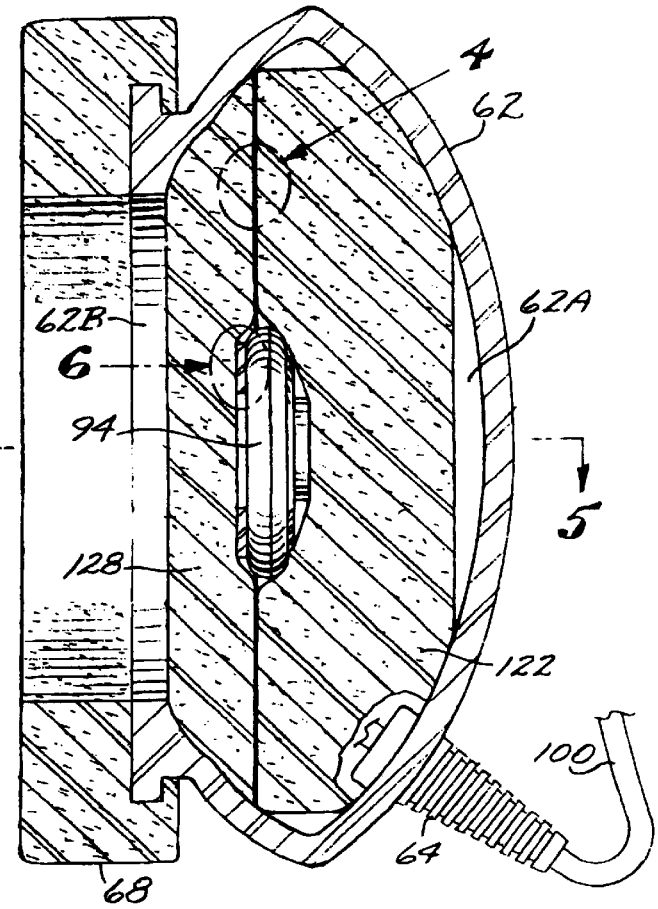
FIG. 3 is a cross-sectional view taken along line 3—3 of FIG. 1.
Figure 4:
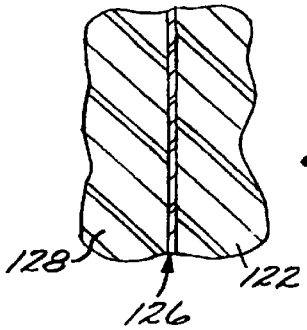
FIG. 4 is an enlarged view of the area within dashed circle 4 of FIG. 3.
Figure 5:
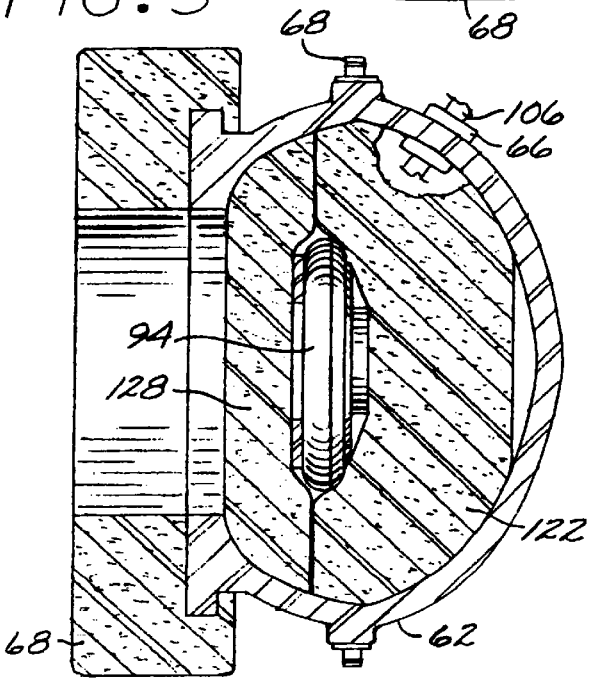
FIG. 5 is a cross-sectional view taken along line 5—5 of FIG. 3.

FIGS. 1–6 illustrate an exemplary embodiment of a communication headset 50 embodying the invention. The headset includes left and right dome structures 60, 70 for fitting over a user's ears, each of the dome structures comprising a rigid outer housing defining an earpiece cavity such as cavity 62A (FIG. 2). Of course, for some applications, the headset may include only a single dome structure, for fitting over one of the user's ears. Typically the housing is fabricated of a hard plastic material A flexible headband structure 80 interconnects the left and right dome structures, with stirrups 80A, 80B having openings at their distal ends which engage respective stirrup dome pins, e.g. pin 68 (FIG. 5). The headset can include a microphone boom 90 mounting a microphone 92 at its distal end, although some applications are listen only, and so the microphone can be omitted. The headset includes in each dome structure an audio transducer such as a speaker to act as an audio receiver for the headset. Although in this embodiment, each dome has an audio transducer or receiver mounted therein, although in other embodiments, the headset may include only a single receiver in one of the dome structures. The headset includes electrical wiring 100 passing through a grommet 64 and an opening in the dome, the wiring 100 terminated in connectors 102, 104 which can be connected to a communication socket for providing the receiver signals from source such as a radio or intercom. For the case in which receivers are mounted in each dome, wiring 106 is passed between the domes, and passes into the domes through grommets 66 (FIG. 5) and 76 (FIG. 1), for connection to the wiring 100 and the receivers in a parallel, series or separate connection, depending on whether monaural or stereo operation is provided.

To the extent just described, the features of the headset are conventional. In accordance with the invention, the receivers are suspended within the respective domes by a suspension structure for supporting the transducer within the cavity without any rigid connection between the transducer and the rigid outer housing. A flexible wiring is passed through the dome structure to the external connector such as 102 or 104, the wiring for carrying the electrical receiver signals to the transducer.

An exemplary embodiment of the suspension structure 120 is illustrated in FIGS. 2–6. The audio transducer 94 is sandwiched within the exemplary dome structure 62 between foam layers 122, 128, with the sound port 94A of the transducer facing toward the user's ear when in use. In this exemplary embodiment, the audio transducer is a micro speaker having a 30 mm diameter, with a samarium cobalt magnetic core and a Mylar diaphragm. In a general sense, the transducer can be any receiver type of audio transducer which can be mounted in a communications headset dome. The speaker is free of any bracketry for hard-mounting to a surface, e.g. defining holes through which fasteners are inserted, set-off structures and the like. For usage in aviation applications, a speaker with a 300 ohm impedance can be employed. For applications for which power is supplied by a battery, e.g. battery-powered radios, a speaker with a 32 ohm impedance can be employed.

The dome structure 62 has a circumferential lip 62B defining an opening 62C facing inwardly towards the user's ear when in use, the opening providing access to the cavity 62A within the dome. A conventional foam or gel ear seal 68 is fitted to the lip structure. Preferably, to provide ambient noise attenuation, the ear seal provides a good seal to the user's head.

The foam layers 122, 128 are fabricated of open cell foam. The layers for this embodiment are fabricated from foam layers of uniform thickness, with layer 122 a relatively thick layer having a thickness of 25 mm, and layer 128 a relatively thin layer having a thickness of 10 mm. The upper and lower edges of the layers are rounded to generally conform to the contour of dome structure. The dimensions of the layers when sandwiched together are such that the cavity 62A within the dome structure will be substantially filled with the sandwiched foam layers 122, 128 when inserted into the cavity through the opening 62C, as illustrated in FIG. 3. For this exemplary embodiment, an open cell foam having a density of 18 kilograms per cubic meter is employed, although other foams and foam densities may alternatively be employed.

Figure 6:
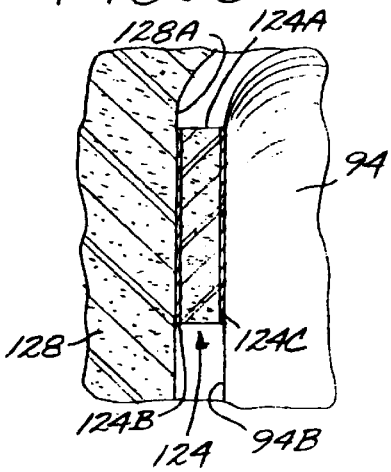
FIG. 6 is an enlarged view of the area within dashed circle 6 in FIG. 3.

The transducer 94 is secured to the foam layer 128, and the foam layers 122, 128 to each other, in this exemplary embodiment by adhesive members 124, 126. Member 124 is in the shape of an annular ring, and is fabricated of a foam, such as EVA polyethylene foam having a thickness of 1.5 mm, wherein each side has adhesive applied thereto. The ring member 124 also serves as a thin spacer element, to space the adjacent surface of the foam layer 128 from the sound port of the speaker. A double-coated acrylic foam tape or liquid adhesive can be employed as the adhesive on each side of the foam ring. As shown in FIG. 6, the member 124 includes an interior annular foam layer 124A having opposed adhesive layers 124B, 124C on opposite surfaces thereof. Adhesive layer 124C contacts and is secured to surface 94B of the transducer 94 surrounding the sound port 94A. Adhesive layer 124B contacts and is secured to an adjacent surface region 128A of the foam layer 128. Each side of the layer 124 is typically supplied with a protective layer (not shown), which is removed just prior to assembly of the layers 122, 128 and the transducer 94.

As shown in FIGS. 3–5, foam layer 128 is adhesively secured to foam layer 122 by an adhesive member 126. The member 126 can be, for example, a layer of adhesive transfer tape, marketed by the 3M Company as part number F-9460P7, although other adhesives and adhesive techniques could alternatively be employed. The member 126 has an opening 126A formed therein, so that the member 126 does not cover the sound port or come into contact with the member 124. The adhesive film layer 126 thus adheres together adjacent surface regions of the foam layers 122, 128 outward of the transducer 94.

The speaker wiring leads 100A are brought out between the layers 122, 128, and connected to the wiring 100. The wiring 100 is passed through an opening formed in the dome 62, which is sealed by a strain relief grommet 64. The grommet 64 seals tightly around the wiring 100, to further attenuate any passage of ambient noise energy through the dome opening and into the dome cavity. To facilitate assembly, a metal tube can be passed through the grommet opening, and the wiring 100 passed through the tube. After the wiring 10 passed through the grommet, the tube can be pulled out and off the end of the wiring, leaving the wiring in place. The connection of wiring 100, 100A and wiring 106 can be performed, and the connections placed in the interior of the dome.

It will be appreciated that the wiring openings through the dome structure are preferably sealed, e.g. by grommets or other sealing structures or techniques, to prevent passage of ambient noise energy through these wiring openings.

The headset domes can be assembled by first forming an assembly of the foam layers 122, 128 sandwiching the transducer 94, with the adhesive members 124, 126 securing the assembly together, and then inserting the assembly through the dome opening 62C into the dome cavity 62A. Alternatively, although less desirably, the assembly process could be done by placing elements serially into the dome cavity, i.e. first the layer 122, then layer 128 with the transducer 94 adhered to it by member 124 and with member 126 in place on layer 128, completing the adhesive securing of the parts inside the cavity.

With the transducer 94 suspended within the dome cavity by the foam assembly, with no rigid connections between the dome 62 and the transducer, ambient noise transfer through the dome of the headset to the interior of the dome is substantially reduced from the conventional technique of rigid fasteners securing the transducer to the dome. In this exemplary embodiment, the noise attenuation in the mid-frequency range of about 700 Hz to 1.8 KHz is on the order of 12 dB. This ambient noise attenuation is achieved without active noise cancellation techniques. Moreover, the use of this suspension system allows the transducer weight to be reduced, since the transducer need not be provided with the bracketry for fastening the transducer to the dome. Thus, as shown in FIG. 2, for example, the transducer is free of any bracketry for rigidly mounting the transducer to the dome housing. As a result, the headset weight can be reduced, resulting in increased comfort for the user.

It is understood that the above-described embodiments are merely illustrative of the possible specific embodiments which may represent principles of the present invention. Other arrangements may readily be devised in accordance with these principles by those skilled in the art without departing from the scope and spirit of the invention. For example, while the headset in FIG. 1 is adapted for use by connection to a radio system or other external electronic system, this invention also has utility for applications in which there is no wiring connection to an external radio system. Such an application includes self-contained wireless intercom or radio systems, wherein all electronics necessary for listen or even two-way communication are built into the headset.

What is claimed is:

1. A communication headset, comprising:

at least one dome structure for fitting over a user's ear, the dome structure comprising a rigid outer housing defining an earpiece cavity;

a support structure for supporting the at least one dome structure in place covering the user's ear;

an audio transducer positioned within said earpiece cavity for converting electrical signals into audible signals; and a suspension structure for supporting the transducer within the earpiece cavity without any rigid connection between the transducer and the rigid outer housing and reducing ambient noise transfer through the dome structure, the suspension structure including a plurality of non-rigid members which sandwich the transducer, wherein the transducer is mounted intermediate between first and second non-rigid members of the plurality of non-rigid members.

2. The communication headset of claim 1, wherein the first and second non-rigid members comprise first and second foam pieces.

3. The communication headset of claim 2, wherein the transducer is sandwiched between a substantially flat surface of the first non-rigid member and a substantially flat surface of the second non-rigid member.

4. The communication headset of claim 1, wherein the suspension structure comprises an adhesive structure.

5. The communication headset of claim 1, wherein the suspension structure comprises a first adhesive structure securing a first side of the transducer to a surface of the first non-rigid member.

6. The communication headset of claim 5, wherein the first side of the transducer has a sound port.

7. The communication headset of claim 6, wherein the first adhesive structure spaces the sound port away from the surface of the first non-rigid member.

8. The communication headset of claim 7, wherein the first adhesive structure comprises a layer of foam with adhesive arranged on two sides of the layer.

9. The communication headset of claim 6, wherein the first adhesive structure comprises an annular ring encircling the sound port.

10. The communication headset of claim 1, comprising a spacer element spacing a sound port on a first side of the transducer from a surface of the first foam piece.

11. The communication headset of claim 1, wherein the suspension structure comprises a first adhesive structure securing the transducer to a surface of the first non-rigid member and a second adhesive structure securing the surface of the first non-rigid member to a surface of the second non-rigid member.

12. The communication headset of claim 1, wherein the transducer is free of any bracketry for rigidly mounting the transducer to the dome structure.

13. The communication headset of claim 1, further comprising:

flexible wiring passed between the transducer and an external connector structure, the wiring for carrying the electrical signals to the transducer.

14. The communication headset of claim 13, wherein the dome structure includes a wiring opening for passing therethrough said wiring, and further comprising a sealing structure for sealing the opening around the wiring.

15. The communication headset of claim 1, wherein the dome structure includes a cavity opening adjacent the user's ear, and further comprising an ear seal positioned about the cavity opening and sized to enclose the user's ear when the dome structure is in position on the user's head.

16. The communication headset of claim 1, wherein the plurality of non-rigid members substantially fill the earpiece cavity.

17. A communication headset, comprising:

at least one dome structure for fitting over a user's ear, the dome structure comprising a rigid outer housing defining an earpiece cavity;

a support structure for supporting the at least one dome structure in place covering the user's ear;

an audio transducer positioned within said earpiece cavity for converting electrical signals into audible signals; and a suspension structure for supporting the transducer within the earpiece cavity without any rigid connection between the transducer and the rigid outer housing and reducing ambient noise transfer through the dome structure, the suspension structure including a plurality of non-rigid members which sandwich the transducer, wherein the transducer is mounted intermediate between first and second non-rigid members of the plurality of non-rigid members and being enclosed by the first and second non-rigid members.

18. The communication headset of claim 17, wherein the first and second non-rigid members comprise first and second foam pieces.

19. The communication headset of claim 18, wherein the transducer is sandwiched between a substantially flat surface of the first non-rigid member and a substantially flat surface of the second non-rigid member.

20. The communication headset of claim 17, wherein the suspension structure comprises an adhesive structure.

21. The communication headset of claim 17, wherein the suspension structure comprises a first adhesive structure securing a first side of the transducer to a surface of the first non-rigid member.

22. The communication headset of claim 21, wherein the first side of the transducer has a sound port.

23. The communication headset of claim 22, wherein the first adhesive structure spaces the sound port away from the surface of the first non-rigid member.

24. The communication headset of claim 23, wherein the first adhesive structure comprises a layer of foam with adhesive arranged on two sides of the layer.

25. The communication headset of claim 22, wherein the first adhesive structure comprises an annular ring encircling the sound port.

26. The communication headset of claim 17, comprising a spacer element spacing a sound port on a first side of the transducer from a surface of the first foam piece.

27. The communication headset of claim 17, wherein the suspension structure comprises a first adhesive structure securing the transducer to a surface of the first non-rigid member and a second adhesive structure securing the surface of the first non-rigid member to a surface of the second non-rigid member.

28. The communication headset of claim 17, wherein the transducer is free of any bracketry for rigidly mounting the transducer to the dome structure.

29. The communication headset of claim 17, further comprising:

flexible wiring passed between the transducer and an external connector structure, the wiring for carrying the electrical signals to the transducer.

30. The communication headset of claim 29, wherein the dome structure includes a wiring opening for passing therethrough said wiring, and further comprising a sealing structure for sealing the opening around the wiring.

31. The communication headset of claim 17, wherein the dome structure includes a cavity opening adjacent the user's ear, and further comprising an ear seal positioned about the cavity opening and sized to enclose the user's ear when the dome structure is in position on the user's head.

32. The communication headset of claim 17, wherein the plurality of non-rigid members substantially fill the earpiece cavity.

33. A communication headset, comprising:

at least one dome structure for fitting over a user's ear, the dome structure comprising a rigid outer housing defining an earpiece cavity;

a support structure for supporting the at least one dome structure in place covering the user's ear;

an audio transducer positioned within said earpiece cavity for converting electrical signals into audible signals;

a suspension structure for supporting the transducer within the earpiece cavity without any rigid connection between the transducer and the rigid outer housing and reducing ambient noise transfer through the dome structure, the suspension structure including a plurality of non-rigid members which sandwich the transducer, wherein the transducer is mounted in a suspension cavity formed by first and second non-rigid members and intermediate between first and second non-rigid members of the plurality of non-rigid members and being enclosed by the first and second non-rigid members.

34. The communication headset of claim 33, wherein the first and second non-rigid members comprise first and second foam pieces.

35. The communication headset of claim 34, wherein the transducer is sandwiched between a substantially flat surface of the first non-rigid member and a substantially flat surface of the second non-rigid member.

36. The communication headset of claim 33, wherein the suspension structure comprises an adhesive structure.

37. The communication headset of claim 33, wherein the suspension structure comprises a first adhesive structure securing a first side of the transducer to a surface of the first non-rigid member.

38. The communication headset of claim 37, wherein the first side of the transducer has a sound port.

39. The communication headset of claim 38, wherein the first adhesive structure spaces the sound port away from the surface of the first non-rigid member.

40. The communication headset of claim 39, wherein the first adhesive structure comprises a layer of foam with adhesive arranged on two sides of the layer.

41. The communication headset of claim 38, wherein the first adhesive structure comprises an annular ring encircling the sound port.

42. The communication headset of claim 33, comprising a spacer element spacing a sound port on a first side of the transducer from a surface of the first foam piece.

43. The communication headset of claim 33, wherein the suspension structure comprises a first adhesive structure securing the transducer to a surface of the first non-rigid member and a second adhesive structure securing the surface of the first non-rigid member to a surface of the second non-rigid member.

44. The communication headset of claim 33, wherein the transducer is free of any bracketry for rigidly mounting the transducer to the dome structure.

45. The communication headset of claim 33, further comprising:

flexible wiring passed between the transducer and an external connector structure, the wiring for carrying the electrical signals to the transducer.

46. The communication headset of claim 45, wherein the dome structure includes a wiring opening for passing therethrough said wiring, and further comprising a sealing structure for sealing the opening around the wiring.

47. The communication headset of claim 33, wherein the dome structure includes a cavity opening adjacent the user's ear, and further comprising an ear seal positioned about the cavity opening and sized to enclose the user's ear when the dome structure is in position on the user's head.

48. The communication headset of claim 33, wherein the plurality of non-rigid members substantially fill the earpiece cavity.

* * * * *